313-422 SR
7/25/78 OR 4,103,205

United States Patent [19]
Credelle

[11] 4,103,205
[45] Jul. 25, 1978

[54] FLAT DISPLAY DEVICE WITH BEAM GUIDE

[75] Inventor: Thomas Lloyd Credelle, East Windsor, N.J.

[73] Assignee: RCA Corporation, New York, N.Y.

[21] Appl. No.: 746,213

[22] Filed: Dec. 1, 1976

Related U.S. Application Data

[63] Continuation-in-part of Ser. No. 607,490, Aug. 25, 1975.

[51] Int. Cl.[2] ..... H01J 29/70; H01J 29/08
[52] U.S. Cl. ..... 313/422; 313/432
[58] Field of Search ..... 315/3, 366; 313/422

[56] References Cited

U.S. PATENT DOCUMENTS 2,858,464 10/1958 Roberts ..... 313/422 X
2,953,707 9/1960 Cook et al. ..... 313/3

*Primary Examiner*—Robert Segal
*Attorney, Agent, or Firm*—Eugene M. Whitacre; Donald S. Cohen; George E. Haas

[57] ABSTRACT

An evacuated envelope has a rectangular display section and a gun section at one side of the display section. The display section includes rectangular front and back walls in closely spaced, substantially parallel relation, and a plurality of spaced, substantially parallel support walls between the front and back walls forming a plurality of parallel channels. The gun section extends across one end of the channels and includes gun structure which will selectively direct one or more electron beams along each of the channels. In each of the channels is a beam guide which utilizes "slalom focusing" to confine the electrons in a direction normal to the front and back walls and guide the beam along the length of the channel wherein the electron beam is confined to an undulating path along the channel. The beam guide also includes means for laterally confining the electrons in the beam. The beam guide also permits selective deflection of the electron beam out of the guide toward a phosphor screen on the inner surface of the front wall.

25 Claims, 16 Drawing Figures

FLAT DISPLAY DEVICE WITH BEAM GUIDE

This is a continuation-in-part of my copending application Ser. No. 607,490, filed Aug. 25, 1975, entitled "Flat Display Device With Beam Guide".

BACKGROUND OF THE INVENTION

The present invention relates to a flat display device including means for scanning an electron beam over the image screen thereof, and particularly to such a device including a guide structure for confining and guiding the beam and for selectively extracting the beam from the guide.

Cathodoluminescent display devices which are presently used commercially, such as the display devices for television, generally include a neck and funnel extending perpendicularly from the screen and are thus relatively deep in the dimension perpendicular to the screen.

It has long been a desire to reduce the depth or thickness of such display devices to provide a substantially flat display device. As shown in U.S. Pat. No. 2,928,014 to W. R. Aiken et al, issued Mar. 8, 1960 entitled "Electronic Device Cathode Ray Tubes", one structure which has been proposed involves a guided beam approach which comprises a thin box-like envelope with one of the large surfaces thereof constituting a faceplate on which a phosphor screen is disposed. An electron gun is provided at one side of the screen, generally at one corner, and is arranged so as to direct a beam of electrons across the device in a path substantially parallel to the screen. Deflection elements are provided to selectively deflect the beam onto successive points of the screen to achieve the desired scanning thereof. The deflection elements are generally in the form of metal film electrodes coated on the back surface and on the sides of the tube.

In using the guided beam technique a problem has arisen in making flat display tubes having large area screens, such as screens which are about 75 cm by 100 cm. For such large size devices some type of internal support structure is required to prevent the evacuated envelope from collapsing. In a device having an internal support structure, the confinement and guiding of the electron beam is more critical than in a device which has no such supporting structure so as to prevent the supporting structure from interfering with the proper scanning of the beam along the screen. Also, in the guided beam flat display devices of the type shown in U.S. Pat. No. 2,928,014, high voltages have been needed to deflect the electron beam. It would be desirable to have such a display device which operates at lower voltages and still achieves satisfactory confinement and guidance of the beam.

SUMMARY OF THE INVENTION

A flat picture display device includes an evacuated envelope having a front wall and a phosphor screen along the inner surface of the front wall. In the device is means for generating one or more beams of electrons and directing each beam in a path generally parallel to and across the front wall. Means are along the beam path for causing the beam to travel in a substantially undulating path but permitting the beam to be deflected out of the path toward the phosphor screen at various selected points along the path. Means are along the beam path for laterally confining the electrons to a relatively narrow beam.

DETAILED DESCRIPTION

Figure 1:
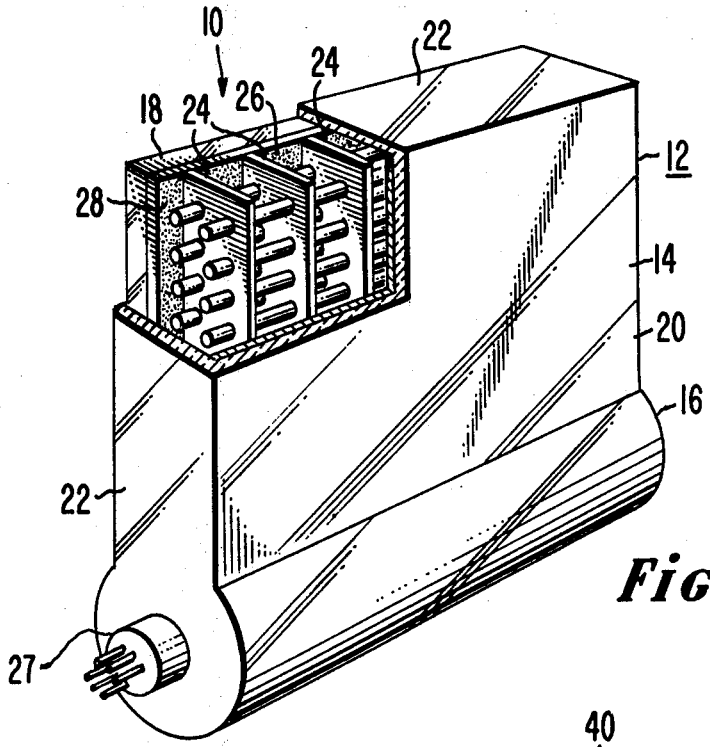
FIG. 1 is a perspective view, partially cut away, of a flat display device which includes the beam guide of the present invention.

Referring to FIG. 1, a flat display device including the beam guide of the present invention is generally designated as 10. The display device 10 comprises an evacuated envelope 12, typically of glass, having a display section 14 and an electron gun section 16. The display section 14 includes a rectangular front wall 18 which is the viewing screen, and a rectangular back wall 20 in spaced parallel relation with the front wall 18. The front wall 18 and back wall 20 are connected by side walls 22. The front wall 18 and back wall 20 are dimensioned to correspond with the size of the viewing screen desired, e.g., about 75 cm by 100 cm and are spaced apart typically about 2.5 to 7.5 cm.

A plurality of spaced, substantially parallel, vertically extending supporting walls 24 are secured between the front wall 18 and the back wall 20. The supporting walls 24 provide the internal support for the evacuated envelope 12 against external atmospheric pressure, and divide the display section 14 into a plurality of vertically extending channels 26. In each of the channels 26 is a beam guide. On the inner surface of the front wall 18 is a phosphor screen 28.

The gun section 16 is an extension of the display section 14 and extends along one set of adjacent ends of the channels 26. The gun section may be of any shape suitable to enclose the particular gun structure contained therein. The electron gun structure contained in the gun section 16 may be of any well-known construction suitable for selectively directing a beam of electrons along each of the channels 26. For example, the gun structure may comprise a plurality of individual guns one being mounted at one end of each of the channels 26 for directing separate beams of electrons along each of the channels.

Alternatively, the gun structure may be a single gun at one end of the gun section 16 which directs an electron beam across the ends of the channels 26 with deflection electrodes being provided along the gun section 16 for selectively deflecting the electron beam into each of the channels 26. One such gun structure is shown in the previously referred to U.S. Pat. No. 2,928,014.

Another type of gun structure which can be used includes a line cathode extending along the gun section 16 across the ends of the channels 26 and adapted to selectively direct individual beams of electrons along the channels. A gun structure of this type is described in U.S. Pat. No. 2,858,464 to W. L. Roberts, issued Oct. 28, 1958, entitled "Cathode Ray Tube".

A terminal 27 extends through a side wall 22 of the envelope 12. The terminal 27 includes a plurality of terminal wires by which the gun structure and other parts of the display within the envelope 12 can be electrically connected to suitable operating circuitry and power source outside of the envelope 12.

A beam guide is disposed in each of the channels 26, and utilizes the technique of slalom focusing which is described in the article entitled, "Slalom Focusing", by J. S. Cook et al, *Proceedings of the IRE,* Vol. 45, November 1957, pages 1517–1522. Slalom focusing, as there described, makes use of a plurality of spaced, parallel wires or rods arranged in a common plane midway between two parallel plates. The wires or rods are charged positively with respect to the plates. The electrostatic field thereby created is such that when a beam of electrons is directed into the space between the plates along the plane of the rods or wires, the beam will weave an undulating path through the array of rods or wires. While such a structure adequately provides for confining the beam along its intended path, it does not provide for extraction of the beam from the structure at selected points as is required in the present invention.

Figure 2A:
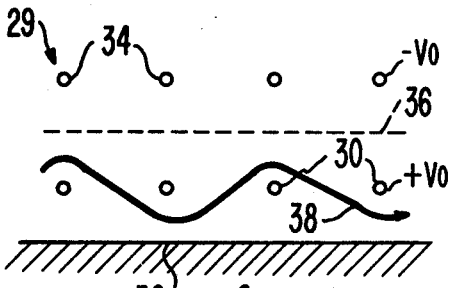
FIGS. 2*a* and 2*b* are schematic views of one form of the beam guide of the present invention and illustrating how it operates.

Referring to FIG. 2*a,* there is shown schematically in simplified form one form of the beam guide which is generally designated as 29 which can be used in the display device 10 to provide focusing and selective deflection of the electron beam. The beam guide 29 comprises a first set of spaced, parallel wires 30 arranged in a common plane between a ground plane 32 and a second set of spaced, parallel wires 34 arranged in a common plane parallel to the ground plane 32. The first set of wires 30 is positioned closer to the ground plane 32 than to the second set of wires 34. The second set of wires 34 contains the same number of wires as contained in the first set of wires 30, and each of the wires 34 is directly over and parallel to a different one of the wires 30. In the operation of this form of the beam guide, a potential $+V_O$ which is positive with respect to the gound plane 32 is applied to each of the wires 30 of the first set, and an equal but negative potential $-V_O$ is applied to each of the wires 34 of the second set. This creates a zero volt plane, indicated by the dashed line 36, between the two sets of wires and parallel to the ground plane 32. Thus as in the article of Cook et al, a beam of electrons directed into the beam guide will follow an undulating path weaving itself through the first set of wires 30 as indicated by the arrow-headed line 38.

Figure 2B:
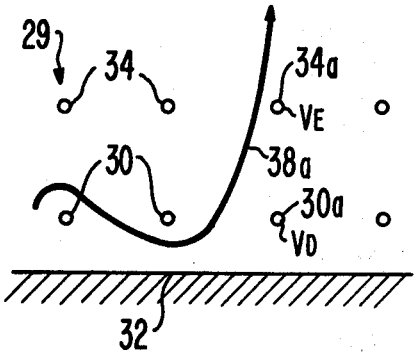

As shown in FIG. 2*b,* to extract the electron beam from the beam guide 29, a wire 30*a* of the first set of wires 30 is switched to a low DC potential, $V_D$, which is less than $+V_O$ and the corresponding wire 34*a* of the second set of wires 34 is switched to a positive DC potential, $V_E$. This changes the electrostatic field so that the beam is deflected away from the ground plane 32 and out of the beam guide 29 between two wires of the second set of wires 34 as shown by the line 38*a*. Thus, by switching the potentials applied to the various pairs of adjacent wires of the two sets of wires 30 and 34, the electron beam can be deflected out of the beam guide 29 at selected points along the beam guide.

Figure 3A:
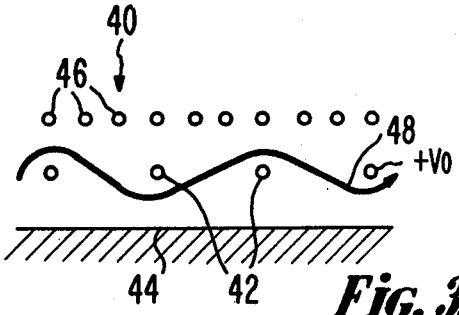
FIGS. 3*a*, 3*b* and 3*c* are schematic views of another form of the beam guide of the present invention and illustrating how it operates.

Referring to FIG. 3*a,* another form of the beam guide which can be used in the display device 10 is generally designated as 40. The beam guide 40 like the beam guide 29 shown in FIG. 2*a,* includes a first set of spaced, parallel wires 42 arranged in a plane between a ground plane 44 and a second set of spaced, parallel wires 46 lying in a common plane parallel to the ground plane 44. However, in the beam guide 40, the number of wires 46 in the second set is greater than the number of wires 42 in the first set, and the first set of wires 42 are positioned midway between the ground plane 44 and the second set of wires 46.

In the operation of the beam guide 40, each of the wires 42 of the first set is at a potential $+V_O$ which is positive with respect to the ground plane 44 and both the ground plane 44 and the second set of wires 46 are at zero potential. This creates an electrostatic field such that when an electron beam is directed into the beam guide, the electron beam will follow an undulating path through the array of the first set of wires 42 as indicated by the arrowheaded line 48.

Figure 3B:
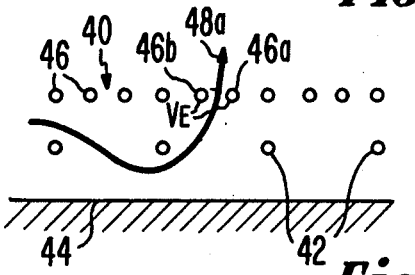

To extract the electron beam from the beam guide 40, two adjacent wires 46*a* and 46*b* of the second set of wires 46 are switched to a positive DC potential $V_E$ which is approximately equal to $+V_O$ as indicated in FIG. 3*b*. This causes the electron beam to be deflected toward the second set of wires 46. The beam passes between the two positively charged wires 46*a* and 46*b* as indicated by the line 48*a* in FIG. 3*b* and out of the beam guide 40. Thus, by switching various pairs of adjacent wires of the second set of wires 46 to a positive potential, the electron beam can be deflected out of the beam guide 40 at selected points along the beam guide.

Figure 3C:
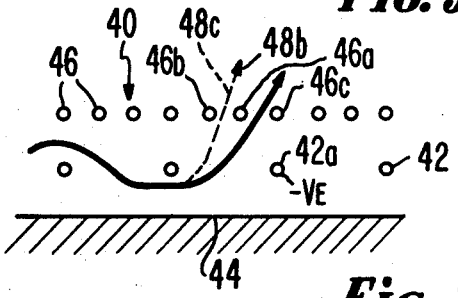

FIG. 3*c* illustrates an alternate manner of operating the beam guide 40 to selectively extract the electron beam. In this manner of operation, one of the wires 42*a* of the first set is switched to a negative voltage $-V_E$, which is not as negative as $-V_O$. This changes the electrostatic field applied to the electron beam so as to deflect the beam toward the second set of wires 46. The electron beam then passes out of the beam guide 40 between two of the wires 46 and 46*a* of the second set of wires 46 as indicated by the solid line 48*b*. If the one wire 42*a* of the first set is switched to a potential more negative than $-V_E$ the electrostatic force applied to the beam causes the beam to deflect further away from the wire 42*a*. This will cause the electron beam to pass out of the beam guide 40 between two different wires 46*a* and 46*b* of the second set as indicated by the dashed line 48*c*. Therefore, by varying the magnitude of the negative potential applied to the wires 42 of the first set, the electron beam can be deflected by different amounts to extract the beam from the beam guide 40 at various selected positions between different parts of adjacent wires 46 which are positioned between adjacent wires 42 of the first set of wires. Thus, this manner of operating the beam guide 40 permits extracting the electron beam at a greater number of positions than can be achieved with the beam guide 27 of FIG. 2 or the manner of operation shown in FIG. 3*b*.

Figure 4:
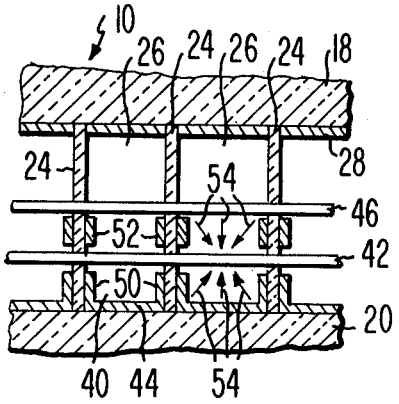
FIG. 4 is a transverse sectional view of a portion of the display device of FIG. 1 looking down the channels in the device and showing one form of the beam guide of the present invention.

Referring to FIG. 4, there is shown a section of the beam guide 40 of FIG. 3 in the display device 10 of the present invention. Since the electron beam must pass along each of the channels 26, the beam guide must also include means for laterally confining the beam in the channel 26 in a direction parallel to the wires 42 to prevent the support walls 24 from interfering with the flow of the electron beam. In each of the channels 26 of the display device 10, the ground plane 44 of the beam guide is a film of an electrically conductive metal on the inner surface of the back wall 20 of the envelope 12. The wires 42 of the first set of wires extend through and are supported by the support walls 24 with each of the wires 42 extending across all of the channels 26. The wires 42 are in spaced relation along the length of the channels 26 and are all in a common plane parallel to the back wall 20. The wires 46 of the second set of wires also extends through and are supported by the support walls 24 with each of the wires 46 extending across all of the channels 26. The wires 46 are in spaced relation along the length of the channels 26, and are in a common plane between the first set of wires 42 and the front wall 18. In each of the channels 26, a first pair of metal film lateral confinement electrodes 50 are on the support wall 24 between the ground plane 44 and the first set of wires 42. The first pair of lateral confinement electrodes 50 extend to the ground plane 44 so as to be electrically connected thereto, but are spaced from the first set of wires 42. A second pair of metal film lateral confinement electrodes 52 are on the support walls 24 between the first set of wires 42 and the second set of wires 46. The second pair of lateral confinement electrodes 52 are spaced from both sets of wires 42 and 46. Both the electrodes 50 and 52 are continuous strips extending the entire length of the channels.

In the operation of the display device 10, each of the second set of wires 46, the ground planes 44, the first pair of lateral confinement electrodes 50 and the second pair of lateral confinement electrodes 52 are at zero potential and each of the first set of wires 42 is at a potential ($+V_O$) which is positive with respect to the ground planes 44. Thus, the electron beam directed along each of the channels 26 from the gun section 16 of the device 10 will follow an undulating path through the array of the first set of wires 42 as previously described with regard to the beam guide 40 shown in FIG. 3. The electric fields created between the wires 42 and the lateral confinement electrodes 50 and 52 apply electrostatic forces to the electrons of the electron beam in the direction indicated by the arrows 54 in FIG. 4 so as to force the electrons toward the central portion of the channel 26. This confines the beam to the central portion of the channel 26 and thereby prevents the support walls 24 from interfering with the beam. By making the potential applied to two adjacent wires 46 of the second set of wires more positive as shown and described with regard to FIG. 3*b* or by switching one of the wires 42 of the first set to a negative potential as shown and described with regard to FIG. 3*c*, the electron beam will be deflected away from ground plane 44 and will pass out of the beam guide toward the front wall 18 and will impinge on the phosphor screen 28 which is at a positive potential with respect to the gun structure. Thus, with the beam guide of the present invention, a confined electron beam can be provided along each of the channels 26 and the beam can be deflected toward the phosphor screen 28 at various selected points along the length of the channels 26. By providing an electron beam or electron beams along the channels 26 and by varying the points of deflection of the beams, horizontal and vertical scanning of the phosphor screen 28 can be achieved to provide a display on the front wall 18 of the display device 10.

A specific example of a beam guide 40 can use wires 42 and 46 which are 0.15 mm in diameter. The wires 42 of the first set of wires can be spaced apart a distance of 1.5 mm and the wires 46 of the second set of wires can be spaced apart a distance of 0.5 mm. The second set of wires 46 can be spaced from the ground plane 44 a distance of1.5 mm. With the second set of wires 46, the ground plane 44 and the confinement electrodes being at zero potential, the first set of wires 42 being at a potential of +300 volts and the cathode of the gun structure being −30 volts, an electron beam directed into the guide 40 will follow an undulating path through the array of the first set of wires 42. The beam can be extracted from the beam guide 40 by either switching two adjacent wires 46 of the second set of wires to a potential of approximately +300 volts or by switching one of the first set of wires 42 to a potential of approximately −100 volts.

Figure 5:
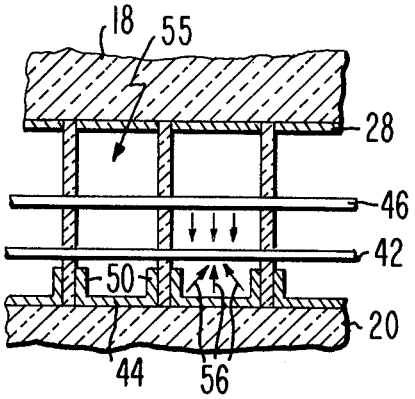
FIG. 5 is a sectional view similar to FIG. 4 of a second form of the beam guide which can be used in the display device of FIG. 1.

Referring to FIG. 5 there is shown a beam guide 55 which is a modified form of the beam guide 40 of FIG. 4. The beam guide 55 in each of the channels 26 is the same as that shown in FIG. 4 except that only the first set of lateral confinement electrodes 50 are provided on the support walls 24. In the operation of this form of the beam guide, the forces created by the electric fields between the first set of wires 42 and the lateral confinement electrodes 50 and ground plane 44 which confine the electron beam to the center portion of the channel 26 are applied to the electron beam only during the time that the electron beam passes between the first set of wires 42 and the ground plane 44 as indicated by the arrows 56. However, since these confinement forces are being applied to the electron beam during about one half of the length of its travel along the channel 26, it is sufficient to maintain the electron beam away from the support walls 24.

Figure 6:
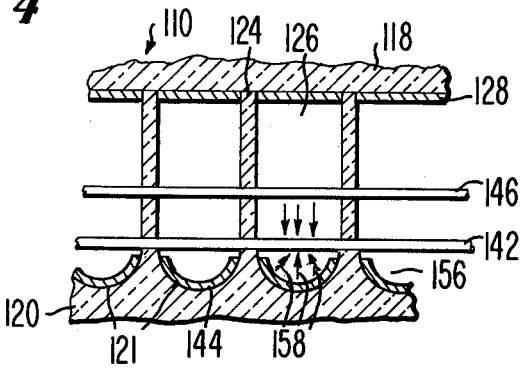
FIG. 6 is a sectional view similar to FIG. 4 of a third form of the beam guide which can be used in the display device of FIG. 1.

Referring to FIG. 6, a modification of the display device of the present invention is generally designated as 110. Display device 110 is of a structure similar to the display device 10 shown in FIG. 1 except that the inner surface of the back wall 120 has a plurality of parallel grooves 121 therein with the grooves being of arcuate cross section, e.g., semicircular. The support walls 124 which are secured between the front wall 118 and the back wall 120 are positioned along the ridges between the grooves 121 so that each of the grooves extends along a separate one of the channels 126. The first set of wires 142 extend through the support walls 124 at the junction of the support walls 124 and the back wall 120. Metal film ground planes 144 are on the surfaces of the grooves 121 so that each of the ground planes 144 is substantially U-shaped with the ends of the ground plane 144 being spaced from the first set of wires 142. The second set of wires 146 extend through the support walls 124 between the first set of wires 142 and the front wall 118. A phosphor screen 128 is on the inner surface of the front wall 118.

The display device 110 operates in the same manner as previously described with regard to the display tube 10 shown in FIG. 4. However, the electric field created between the U-shaped ground planes 144 and the wires 142 create electrostatic forces as indicated by the arrows 158 so that when the electron beam passes between the first set of wires 142 and the ground plane 144 the beam is confined to the central portion of the channel 126. Thus, the ground plane 144 also serves as the lateral confinement electrodes so that laterally confining forces are applied to the electron beam during about one half of its length of travel along the channel 126 in a manner similar to that of the form of the beam guide shown in FIG. 5 but without the need of confinement electrodes on the support walls 124.

Figure 7:
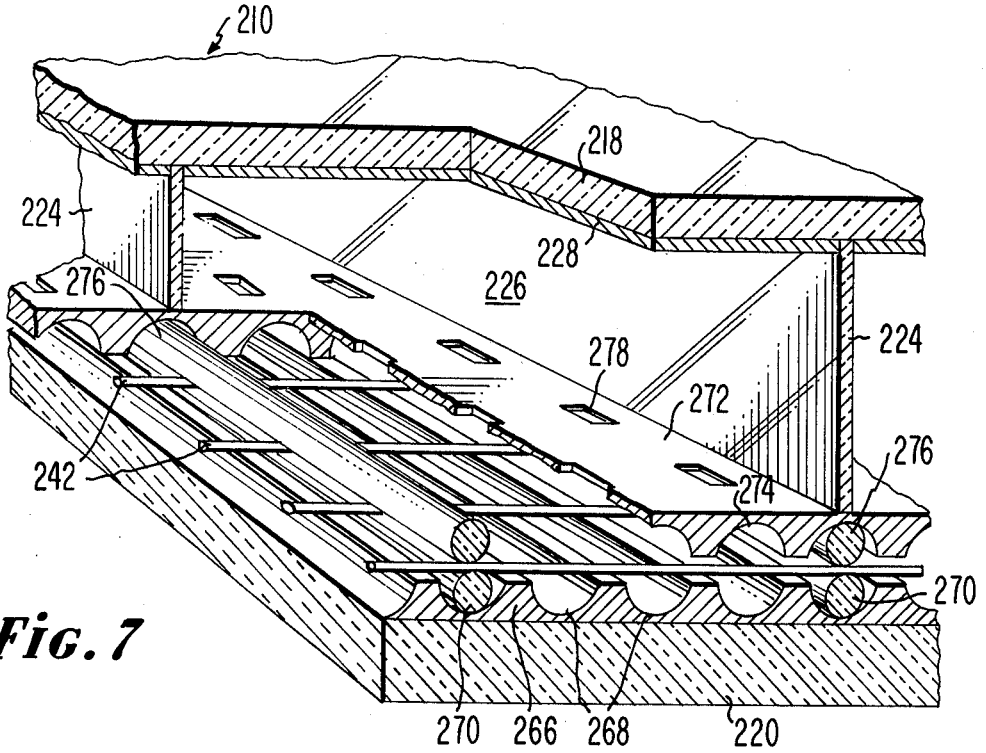
FIG. 7 is a sectional perspective view of a fourth form of the beam guide which can be used in the display device of FIG. 1.

Referring to FIG. 7, a display device having another form of the beam guide of the present invention is generally designated as 210. The display device 210 includes front and back walls 218 and 220, respectively, and spaced support walls 224 extending between the front and back walls and forming a plurality of channels 226. A first metal ground plate 266 is disposed on the inner surface of the back wall 220. The first ground plate 266 has a plurality of spaced, substantially parallel grooves 268 in its surface which faces the front wall 218. Each of the grooves 268 is arcuate, e.g. semicircular, in cross section and extends in the same direction as the channels 226 between the support walls 224. Elongated spacer rods 270 of an electrical insulating material, such as glass, are in spaced ones of the grooves 268 with at least one groove 268 being between each pair of adjacent spacer rods 270. The spacer rods 270 are of a diameter slightly greater than the depth of the grooves 268 so that the spacer rods project slightly out of the grooves 268. A set of spaced, parallel wires 242 extend across and engage the spacer rods 270. Since the spacer rods 270 project beyond the grooves 268, the wires 242 are spaced from the first ground plate 266.

A second metal ground plate 272 is parallel to the first metal ground plate 266 but on the side of the set of wires 242 toward the front wall 218. The second ground plate 272 has a plurality of spaced, parallel grooves 274 in its surface facing the first ground plate 266. The grooves 274 are arcuate, e.g. semicircular, in cross section and are mutually coextensive in length and face a corresponding groove 268 in the first ground plate 266. Elongated spacer rods 276 of an electrical insulating material, such as glass, are disposed in the grooves 274 which mate with the grooves 268 containing the spacer rods 270. The spacer rods 276 are of a diameter slightly greater than the depth of the grooves 274 so as to project slightly out of the grooves 274. The spacer rods 276 engage the set of wires 242 so as to space the second ground plate 272 from the wires 242.

The second ground plate 272 has a plurality of openings 278 therethrough. The openings are arranged in aligned rows along the bottoms of the grooves 274. Each of the openings 278 is elongated along the length of the grooves 274 and is positioned in a space between the wires 242. The support walls 224 extend between the front wall 218 and the second ground plate 272 and are positioned along the grooves of the ground plate which contain the spacer rods 270 and 276 so as to provide mechanical support between the front wall 218 and the back wall 220. Although the display device 210 is shown having three pairs of mating grooves 268 and 274 along each of the channels 226 between the support walls 224, the support walls 224 can be either closer together or further apart to provide any desired number of the mating grooves along each of the channels. The grooves 268 and 274 can be rectangular instead of arcuate and serve their intended purpose. Also, the ground plates 266 and 272 can be flat metal plates with a plurality of spaced, parallel projections or ribs extending from the surface of the plates to form in essence the equivalent of the grooves. A phosphor screen 228 is on the inner surface of the front wall 218 in each of the channels 226.

In the operation of the display device 210, each of the ground plates 266 and 272 are at zero potential, and the wires 242 are at a positive potential. Thus, an electron beam which is directed into each pair of mating grooves 268 and 274 will follow an undulating path along the array of the wires 242. The grooves 268 and 274 create an electrostatic field which confines the beam to substantially the center line of the grooves in the manner described with regard to the beam guide shown in FIG. 6 but with the lateral confinement forces being applied along the entire undulating path of the beam. By switching selected ones of the wires 242 to a negative potential, the electron beam will be deflected toward the second ground plate 272 and will pass out of the beam guide through one of the openings 278 in the manner described with regard to the manner of operation shown in FIG. 3c. Since the openings 278 are elongated, by varying the magnitude of the potential applied to the respective wire 242, the angle of deflection can be varied so that the electron beam will impinge on the phosphor screen 228 at various points.

Figure 8:
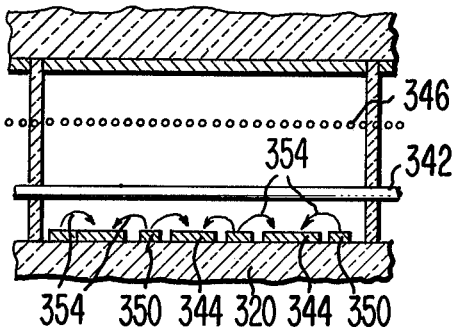
FIGS. 8–13 are transverse sectional views similar to FIG. 4 and of a different form of a beam guide which can be used in the display device of FIG. 1.

Referring to FIG. 8 there is shown another modification of the focusing guide of the present invention. The focusing guide includes a first set of wires 342 between first and second ground planes 344 and 346. The first ground plane 344 comprises a plurality of spaced, parallel, metal film strips on the inner surface of the back wall 320 and extending longitudinally along the channel. Each of the metal strips extends along a separate beam path. Between the metal strips of the first group plane 344 are lateral confinement electrodes 350. The lateral confinement electrodes 350 are metal films on the inner surface of the back wall 320 and extending longitudinally along the channels between and spaced from the metal film strips of the first ground plane 344. The second ground plane 346 is a wire mesh extending across the first set of wires 342 substantially parallel to the back wall 320. The second ground plate 346 can alternatively be either a second set of wires as shown in FIGS. 4, 5 and 6, or a metal plate having holes therethrough, such as shown in FIG. 7.

In the operation of the focusing guide the first set of wires 342 are each at a potential which is positive with respect to the first and second ground planes 344 and 346. Thus, an electron beam directed into the focusing guide at each of the metal strips of the first ground plane 344 will follow an undulating path through the array of the first set of wires 324 as previously described. The lateral confinement electrodes 350 are each at a potential slightly less than the potential applied to the first ground plane 344. The potential difference between the lateral confinement electrodes 350 and the first ground plane 344 creates electrostatic force fields as indicated by the arrows 354 which laterally confine the electrons in the beam as the beam travels longitudinally along the metal strip of the first ground plane 344.

Figure 9:
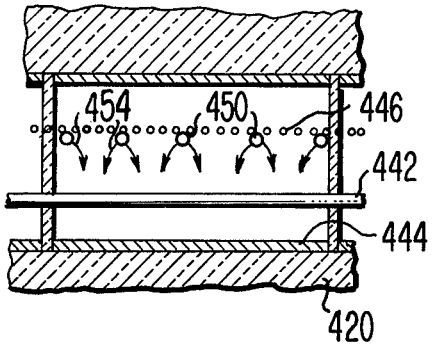

Referring to FIG. 9 there is shown another form of the focusing guide of the present invention. The focusing guide includes a first set of spaced, parallel, coplanar wires 442 extending transversely across the channels between first and second ground plane members 444 and 446. The first ground plane member 444 is a metal film on the inner surface of the back wall 420. The second ground plane member 446 may be a wire mesh extending transversely across and longitudinally along the channels, a plurality of spaced, parallel, coplaner wires extending transversely across the channels such as shown in FIGS. 4, 5 and 6, or a plurality of spaced, parallel, coplanar wires extending longitudinally along the channels. Lateral confinement electrodes 450 extend along the second ground plane member 446 longitudinally of the channels and on opposite sides of the beam paths. The metal confinement electrodes 450 are wires which are greater in diameter than the diameter of the wires of the second ground plane member 446 so that the metal confinement electrodes 450 project from the second ground plane member 446 toward the first set of wires 442.

In the operation of the focusing guide, the first set of wires 442 are at a potential more positive than the first and second ground plane members 444 and 446. As previously described, an electron beam directed along the channel will thus follow an undulating path through the array of the first set of wires 442. The lateral confinement electrodes 450 are at the same potential as the second ground plane member 446. Since the lateral confinement electrodes 450 project beyond the second ground plane member 446 electrostatic forces are created between the lateral confinement electrodes 450 and the first set of wires 442 as indicated by the arrows 454 which laterally confine the electrons to the beam as the beam passes along the channel.

Figure 10:
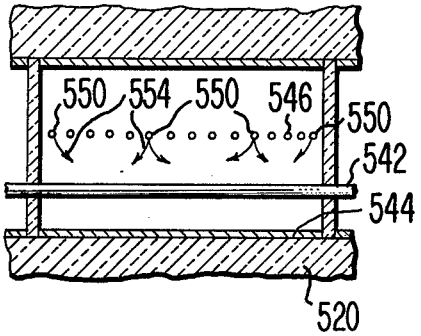

Referring to FIG. 10 there is shown still another modification of the focusing guide of the present invention. The focusing guide includes a first set of spaced, parallel, coplanar wires 542 extending transversely across the channel between first and second ground plane members 544 and 546. The first ground plane member 544 is a metal film on the inner surface of the back wall 520. The second ground plane member 546 comprises a plurality of parallel, coplanar wires extending longitudinally along the channel and spaced transversely across the channel. Lateral confinement electrodes 550 extend longitudinally along the channels on opposite sides of the beam paths. The lateral confinement electrodes 550 are wires which are coplanar with the second ground plane member 546 and extend between but are spaced from the wires of the second ground plane member.

In the operation of the focusing guide the first set of wires 542 are at a potential greater than that on the first and second ground plane members 544 and 546. Thus, a beam of electrons directed into the focusing guide will follow an undulating path through the array of the first set of wires 542. The lateral confinement electrodes 550 are at a potential slightly less than that of the second ground plane member 546. This creates electrostatic forces as indicated by the arrows 554 which laterally confine the electrons in the beam as the beam passes along the focusing guide. This focusing guide is similar in structure and operation to the focusing guide shown in FIG. 8 except that the lateral confinement electrodes are along the second ground plane member rather than the first ground plane member so that the lateral confinement forces are applied to the beam as it passes between the first set of wires and the second ground plane member rather than as the beam passes between the first set of wires and the first ground plane member.

Figure 11:
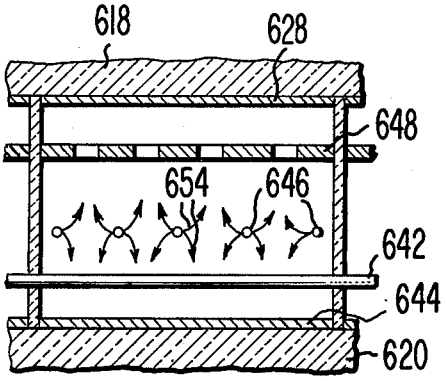

Referring to FIG. 11 there is shown still another form of the focusing guide of the present invention. The focusing guide includes a first set of spaced, parallel, coplanar wires 642 extending transversely across the channel between a first ground plane member 644 and a second set of wires 646 which serve to form the same function as a second ground plane member. The first ground plane member 644 is a metal film on the inner surface of the back wall 620. The second set of wires 646 include a plurality of parallel, coplanar wires extending longitudinally along the channel and spaced transversely across the channel. The wires 646 are positioned along opposite sides of the path of the beam of electrons along the channel. A metal grid 648 extends transversely across the channel between the second set of wires 646 and the phosphor screen 628 on the inner surface of the front wall 618. The metal grid 648 may be a film on the phosphor screen 628. However, if the metal grid 648 is spaced from the phosphor screen the metal grid should have a plurality of openings therethrough to allow the electron beams to pass therethrough to the phosphor screen.

In the operation of the focusing guide the first set of wires 624 are at a potential positive with respect to the first ground plane member 644 and the second set of wires 646. The potential applied to the second set of wires 646 is such that the force field created between the second set of wires 646 and the first set of wires 642 is equivalent to that which would be achieved by a ground plane member so that a beam of electrons directed into the focusing guide will follow an undulating path through the array of the first set of wires 642. A potential is applied to the metal grid 648 which is highly positive with respect to the potential applied to the second set of wires 646. The potential difference between the second set of wires 646 and each of the first set of wires 646 and the grid plate 648 creates electrostatic force fields as indicated by the arrows 654 which laterally confine the electrons in the beam as the beam passes along the focusing guide.

Figure 12:
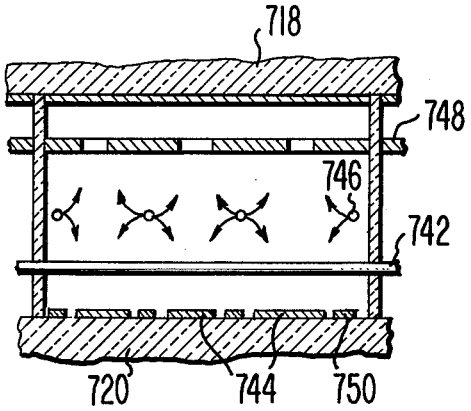

In the focusing guide shown in FIGS. 5, 6, 8, 9, 10 and 11 lateral confinement of the electrons in the beam is achieved during only one half of each cycle of the beam through the focusing guide. In the focusing guide shown in FIGS. 5, 6 and 8 the lateral confinement is achieved only as the beam passes between the first set of wires and the first ground plane whereas in the focusing guide shown in FIGS. 9, 10 and 11 the lateral confinement is achieved only as the beam passes between the first set of wires and the second ground plane. Lateral confinement can be achieved during the entire cycle of the beam, i.e., on both sides of the first set of wires, by combining these various types of focusing guides. For example, in the focusing guide shown in FIG. 12, the focusing guide shown in FIG. 8 is combined with the focusing guide shown in FIG. 11. This results in a first ground plane number 744 which comprises a plurality of spaced, parallel, metal film strips on the inner surface of the back wall 720 and extending longitudinally along the channel with lateral confinement electrodes 750 on the inner surface of the back wall 720 between the ground plane number strips, and a second ground plane and lateral confinement means provided by a plurality of spaced, parallel wires 746 extending longitudinally along the channel and a grid plate 748 between the wires 747 and the front wall 718 of the display envelope. As previously described with regard to FIGS. 8 and 11, the lateral confinement electrodes 750 provide lateral confinement of the electrons in the beam as the beam passes between the first set of wires 742 and the first ground plane 744 and the wires 746 provide lateral confinement of the electrons as the beam passes between the first set of wires 742 and the wires 746.

Figure 13:
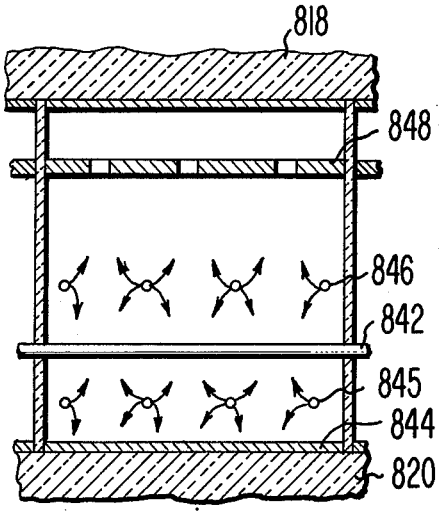

In the focusing guide shown in FIG. 13 the lateral confinement means shown in FIG. 11 is used on both sides of the first set of wires 842. On the inner surface of the back wall 820 is a metal film grid 844 and between the metal grid 844 and the first set of wires 842 is a second set of wires 845. The second set of wires 845 extend longitudinally along the channel and are in spaced, parallel relation transversely of the channel with the wires being positioned at opposite sides of the beam paths. A metal grid 848 is between the first set of wires 842 and the front wall 818 of the display envelope, and a third set of wires 846 is between the first set of wires 842 and the grid 848. The third set of wires 846 extend longitudinally along the channel with each of the wires 846 extending along a separate one of the wires 845. In the operation of the focusing guide the first set of wires 842 is at a potential positive with respect to each of the second set of wires 845 and the third set of wires 846, and each of the grids 844 and 848 are at a potential substantially more positive than that on the second set of wires 845 and third set of wires 846 respectively. The relative potentials applied to the wires 842, 845 create an electrostatic field between the first set of wires 842 and each of the second set of wires 845 and third set of wires 846 which will cause an electron beam injected into the focusing guide to follow an undulating path through the array of the first set of wires. As previously described with regard to FIG. 11, the potential difference between the second set of wires 845 and the grid 844 and the third set of wires 846 and the grid 848 creates electrostatic force fields which laterally confine the electrons to the beam as the beam passes along the focusing guide.

Thus, there is provided by the present invention a flat display device in which beam guides which utilize slalom focusing, are provided in channels in an evacuated envelope to guide beams along the channels. The beam guides also have means for laterally confining the electrons in the beam as the beam passes along the guides to maintain the cross sectional dimension of the beam. The beam guides also include means for deflecting the beam at various points along the length of the channel toward the phosphor screen of the display device.

I claim:

1. An electron display device comprising:

an evacuated envelope having a front wall, a phosphor screen on the inner surface of said front wall, means in said device for generating a beam of electrons and directing said beam in a path generally parallel to and across said front wall, means along said beam path for causing said beam to travel in a substantially undulating path with the undulations thereof toward and away from said screen and for selectively deflecting said beam out of said path toward said phosphor screen at selected points along said path, and means along said path for laterally confining the electrons to a relatively narrow beam.

2. An electron display device in accordance with claim 1 in which the means for causing the beam to travel in an undulating path includes a set of spaced, parallel electrical conductors substantially parallel to said front wall, and means forming ground planes on each side of said conductors with said ground planes being spaced from and substantially parallel to said conductors.

3. An electron display device in accordance with claim 2 in which the means forming the ground plane on the side of the set of conductors toward the phosphor screen has openings through which the electron beam can pass when the beam is deflected.

4. An electron display device in accordance with claim 3 in which the means for laterally confining the electrons includes a conductor extending longitudinally along said beam path at each side of said beam path.

5. An electron display device comprising:

an evacuated envelope having closely spaced, substantially parallel, front and back walls, and a plurality of spaced, substantially parallel support walls extending substantially perpendicularly between said front and back walls and forming a plurality of channels extending across said front and back walls, a phosphor screen along the inner surface of said front wall in each of said channels, means at one end of said channels for generating and directing electrons along each of said channels, means along each of said channels for causing said electrons to travel as beams of electrons in substantially undulating paths but permitting said beams to be deflected out of said paths toward said phosphor screen at selected points along said paths, and means along each of said paths for laterally confining the electrons to a relatively narrow beam.

6. An electron display device in accordance with claim 5 in which the means for causing the beam to travel in an undulating path includes a set of spaced, parallel wires substantially parallel to the walls of said device and extending across said channels, means for forming a first ground plane substantially parallel to and spaced from said set of wires between said set of wires and the back wall and means for forming a second ground plane substantially parallel to and spaced from said set of wires between said set of wires and the front wall.

7. An electron display device in accordance with claim 6 in which the means forming the second ground plane has a plurality of spaced openings through which the electron beam can pass when the beams are deflected.

8. An electron display device in accordance with claim 7 in which the means for laterally confining the electrons in each beam includes a conductor extending longitudinally along each side of each beam path.

9. An electron display device in accordance with claim 8 in which the means forming the first ground plane includes a metal member extending along the inner surface of the back wall and the laterally confining conductors extend along said metal member.

10. An electron display device in accordance with claim 9 in which the laterally confining conductors are projections extending between the metal member and said wires.

11. An electron display device in accordance with claim 10 in which the laterally confining conductors are on the surface of the support walls and extending along the channel between the set of wires and the metal member.

12. An electron display device in accordance with claim 10 in which the laterally confining conductors project from the metal member.

13. An electron display device in accordance with claim 12 in which the metal member is a plate having a plurality of spaced, parallel grooves in its surface facing the front wall and extending longitudinally along the chamber with at least one groove being in each chamber, the side of said grooves forming the laterally confining conductors.

14. An electron display device in accordance with claim 13 in which the grooves are arcuate in cross section.

15. An electron display device in accordance with claim 9 in which the back wall has a plurality of parallel grooves in its inner surface, each of said grooves being of arcuate cross section and extending longitudinally along a channel and a metal film on the surface of each of said grooves, said metal film forming the first metal ground plane and the laterally confining conductors.

16. An electron display device in accordance with claim 9 in which the first ground plane comprises a plurality of metal films on the inner surface of the back wall and extending longitudinally along the channels with each of the ground plane films being along a separate beam path, and the laterally confining conductors are metal films on the inner surface of the back wall with a confining conductor extending along each side of each of the ground plane films.

17. An electron display device in accordance with claim 8 in which the first ground plane and the laterally confining means include a metal film extending across the inner surface of the back wall and a plurality of spaced, parallel wires extending longitudinally along each channel between the back wall and the first said set of wires.

18. An electron display device in accordance with claim 8 in which laterally confining conductors are between said set of wires and the front wall of the envelope.

19. An electron display device in accordance with claim 18 in which the laterally confining conductors are on the surfaces of the support walls and extend along the channels between the set of wires and the second ground plane means.

20. An electron display device in accordance with claim 18 in which the laterally confining conductors are spaced, parallel wires extending longitudinally along the channels.

21. An electron display device in accordance with claim 20 in which the second ground plane means is a conductive member extending transversely across and longitudinally along the channels and the laterally confining wires extend along the ground plane conductive member.

22. An electron display device in accordance with claim 21 in which the laterally confining wires project from the ground plane conductive member toward the first set of wires.

23. An electron display device in accordance with claim 21 in which the ground plane conductive member comprises a plurality of coplanar wires extending longitudinally along the channels and spaced transversely across the channels and the laterally confining wires are in the same plane as but are spaced from the wires of the ground plane conductive member.

24. An electron display device in accordance with claim 18 in which the second ground plane means is a metal plate and the laterally confining conductors are projections extending from the plate toward the first set of wires.

25. An electron display device in accordance with claim 24 in which the metal plate has a plurality of spaced parallel grooves in its surface facing the back wall and extending longitudinally along the chamber with at least one groove being in each chamber, the sides of said grooves forming the laterally confining conductors.

* * * * *